US006267199B1

(12) United States Patent
Chang

(10) Patent No.: US 6,267,199 B1
(45) Date of Patent: Jul. 31, 2001

(54) AUTOMOBILE EXHAUST TUBE

(75) Inventor: Ming-Tien Chang, Nan Tou (TW)

(73) Assignee: Sound Ware Industry Co., Ltd., Chang-Hua (TW)

( * ) Notice: Subject to any disclaimer, the term of this patent is extended or adjusted under 35 U.S.C. 154(b) by 0 days.

(21) Appl. No.: 09/418,842

(22) Filed: Oct. 15, 1999

(51) Int. Cl.[7] ..... F01N 1/10
(52) U.S. Cl. ..... 181/252
(58) Field of Search ..... 181/227, 228, 181/252, 256, 258

(56) References Cited

U.S. PATENT DOCUMENTS

| | | | | |
|---|---|---|---|---|
| 2,855,068 | * | 10/1958 | Chapel | 181/42 |
| 3,698,510 | * | 10/1972 | Blatt et al. | 181/36 A |
| 3,757,892 | * | 9/1973 | Raudman, Jr. | 181/36 C |
| 3,794,137 | * | 2/1974 | Teodorescu | 181/33 E |
| 4,108,275 | * | 8/1978 | Black et al. | 181/252 |
| 4,113,051 | * | 9/1978 | Moller | 181/231 |
| 4,371,054 | * | 2/1983 | Wirt | 181/252 |
| 4,408,679 | * | 10/1983 | Littrell | 181/243 |
| 4,421,202 | * | 12/1983 | Hoy | 181/252 |
| 4,475,623 | * | 10/1984 | Gerber et al. | 181/232 |
| 4,589,515 | * | 5/1986 | Omura | 181/227 |
| 4,792,014 | * | 12/1988 | Shin-Seng | 181/280 |
| 4,841,728 | * | 6/1989 | Jean et al. | 60/312 |
| 4,932,495 | * | 6/1990 | Chapman | 181/242 |

* cited by examiner

*Primary Examiner*—Robert E. Nappi
*Assistant Examiner*—Kimberly Lockett
(74) *Attorney, Agent, or Firm*—Harrison & Egbert

(57) ABSTRACT

An exhaust tube of the rear of an automobile includes a muffler tube and an outer tube. The muffler tube is provided with a plurality of holes in a central area therof. One end of the muffler tube is provided with a concave annular trough and further provided with a convex edge. One end of the outer tube is received within the concave annular trough when the muffler tube is combined with the outer tube. In addition, the inner side of outer tube near the end edge is engaged against the convex edge of the muffler tube.

3 Claims, 4 Drawing Sheets

AUTOMOBILE EXHAUST TUBE

FIELD OF THE INVENTION

The present invention relates generally to an exhaust tube, and more particularly to the automobile exhaust tube.

BACKGROUND OF THE INVENTION

An aluminum alloy is more welcome than the other alloy materials in producing the conventional exhaust tube due to its low density and durability. However, as shown in FIG. 1, the joint C is melted to create the connection between the outer tube A and the muffler tube B. Such construction is defective in design and not cost-effective.

SUMMARY OF THE INVENTION

The primary objective of the present invention to provide an improved exhaust tube at the rear of an automobile which is free from the shortcomings of the conventional automobile exhaust tube described above.

In keeping with the principle of the present invention, the foregoing objective of the present invention is attained by the combination element of a muffler tube and an outer tube. The connection between the muffler tube and the outer tube can be combined without welding. It is therefore the present invention is cost-effective and quickly installed.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
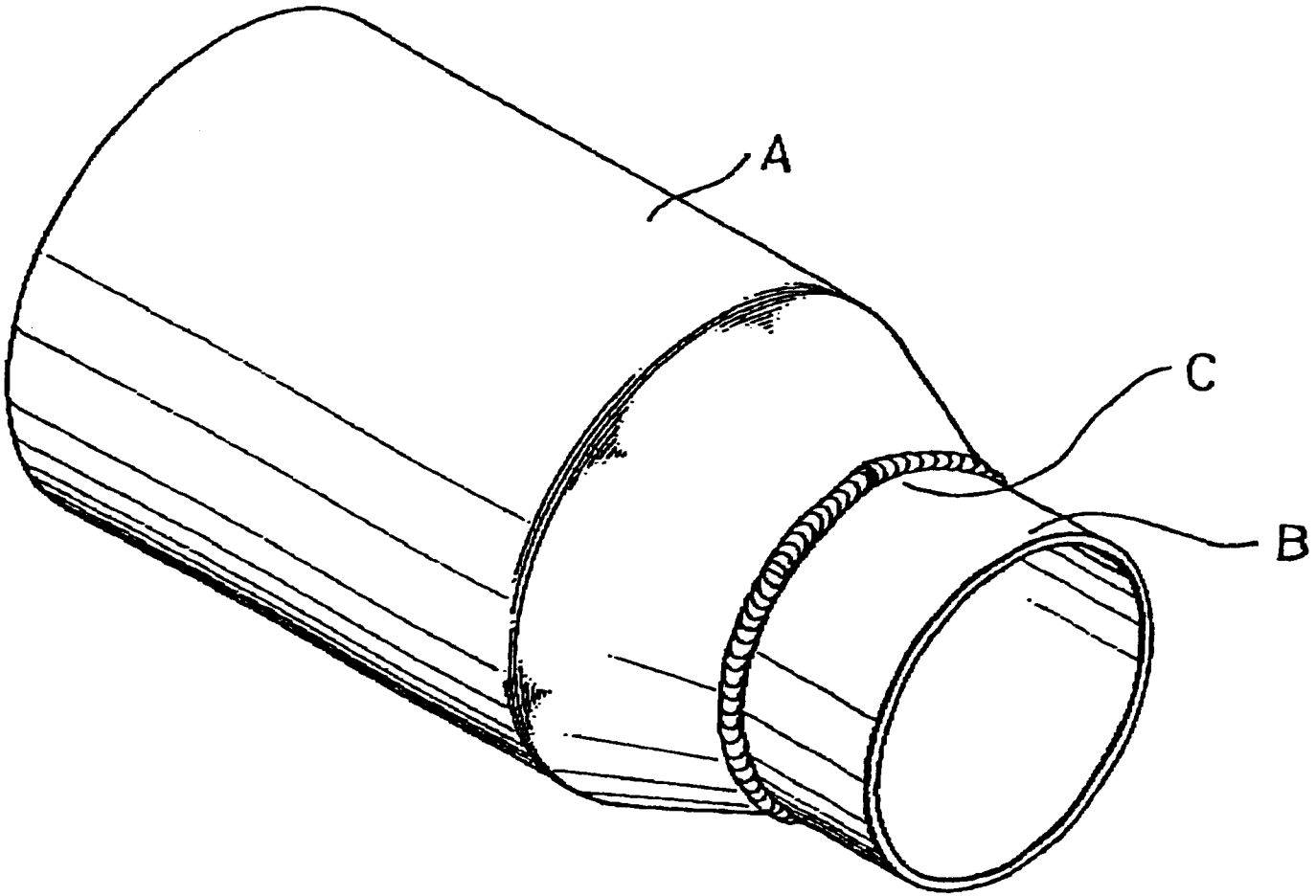
FIG. 1 shows a perspective schematic view of an exhaust tube of the prior art.
Figure 2:
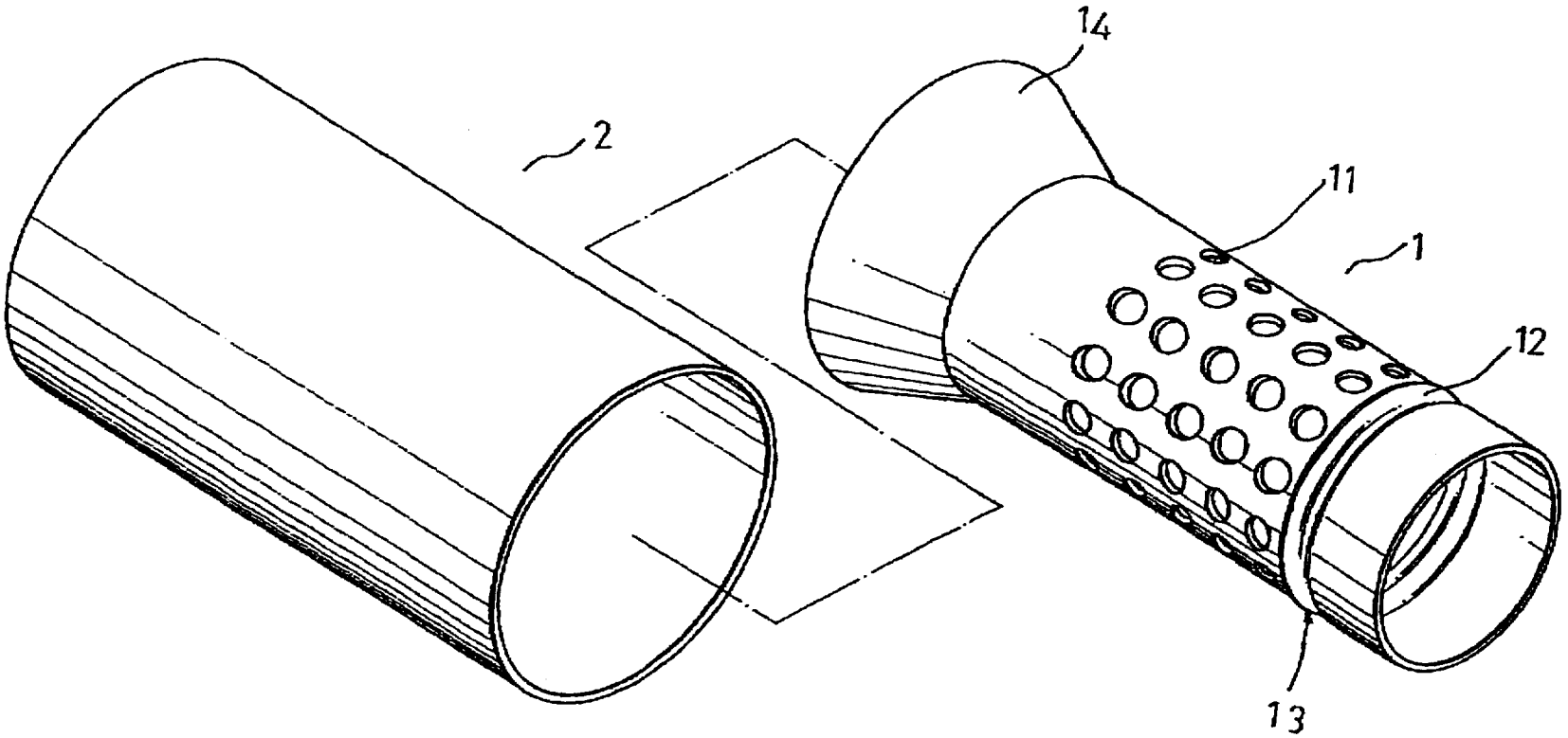
FIG. 2 shown an exploded view of the preferred embodiment of the present invention.

As shown in FIG. 2, an exhaust tube of the present invention is comprised of a muffler tube 1 and an outer tube 2.

The muffler tube 1 is a tubular body of proper length which is provided with a plurality of holes 11 at the central area of muffler tube 1. One end of the tubular body is provided with a concave annular trough 12 and further provided with a convex edge 13 for providing the end edge 22 of one end of the interior inner portion of the outer tube 2 to be engaged against the concave annular trough 12 when the muffler tube 1 is combined with the outer tube 2. In addition, an inner surface of the outer end 2 near the tube edge 22 is engaged against the convex edge 13 of the muffler tube 1. Therefore, the connection between the muffler tube 1 and the outer tube 2 is fixed and firm. The other end of the muffler tube 1 is formed as a trumpet outlet 14.

The outer tubular body 2 is a hollow tube body. One end 21 of the outer tube 2 comes into contact with the trumpet outlet 14 of the muffler tube 1, and the end edge 22 of the other end of outer tube 2 is retained in the concave annular trough 12 of the muffler tube 1.

Figure 3:
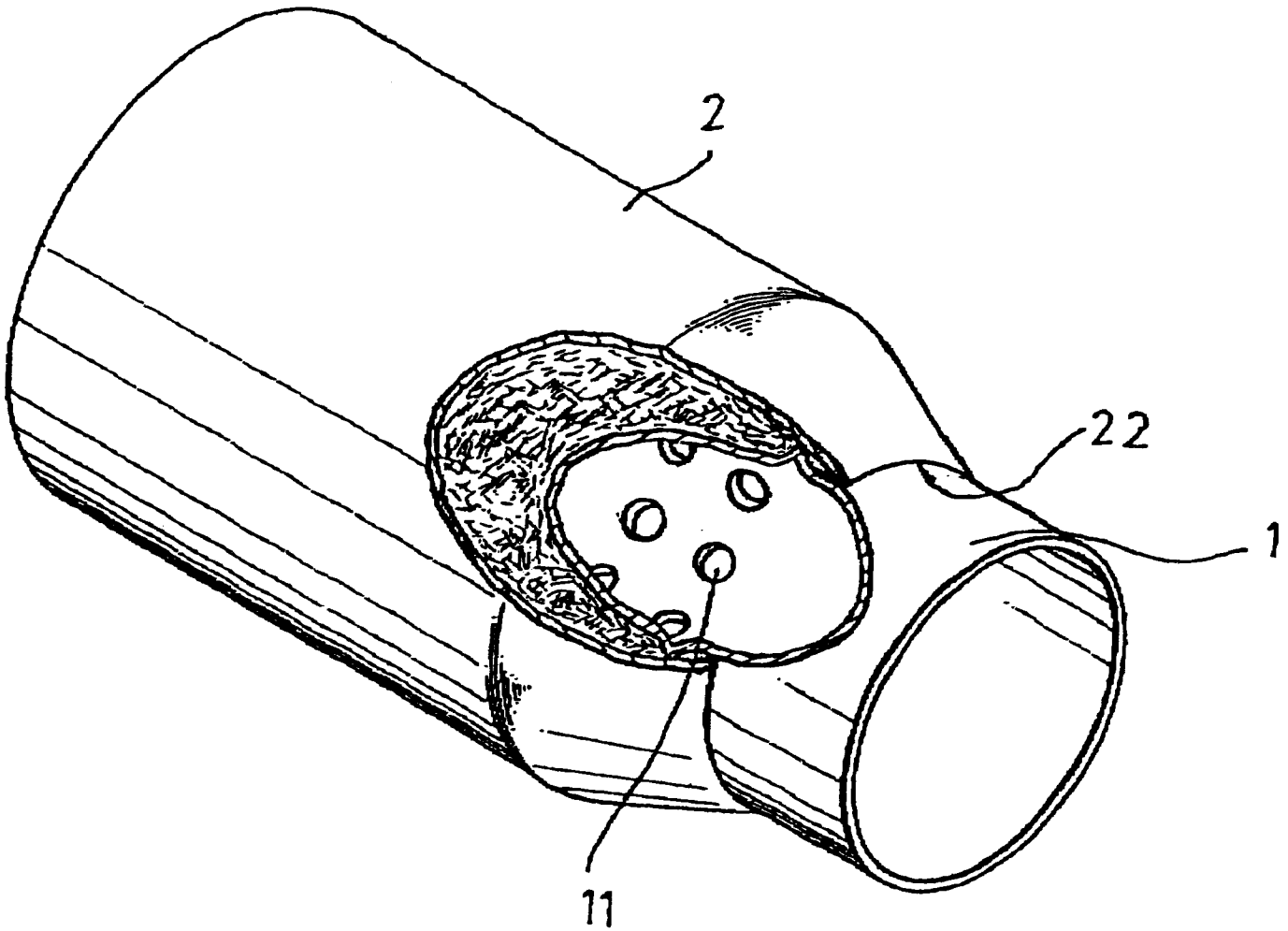
FIG. 3 shows a portion sectional schematic view of the preferred embodiment of the present invention.
Figure 4:
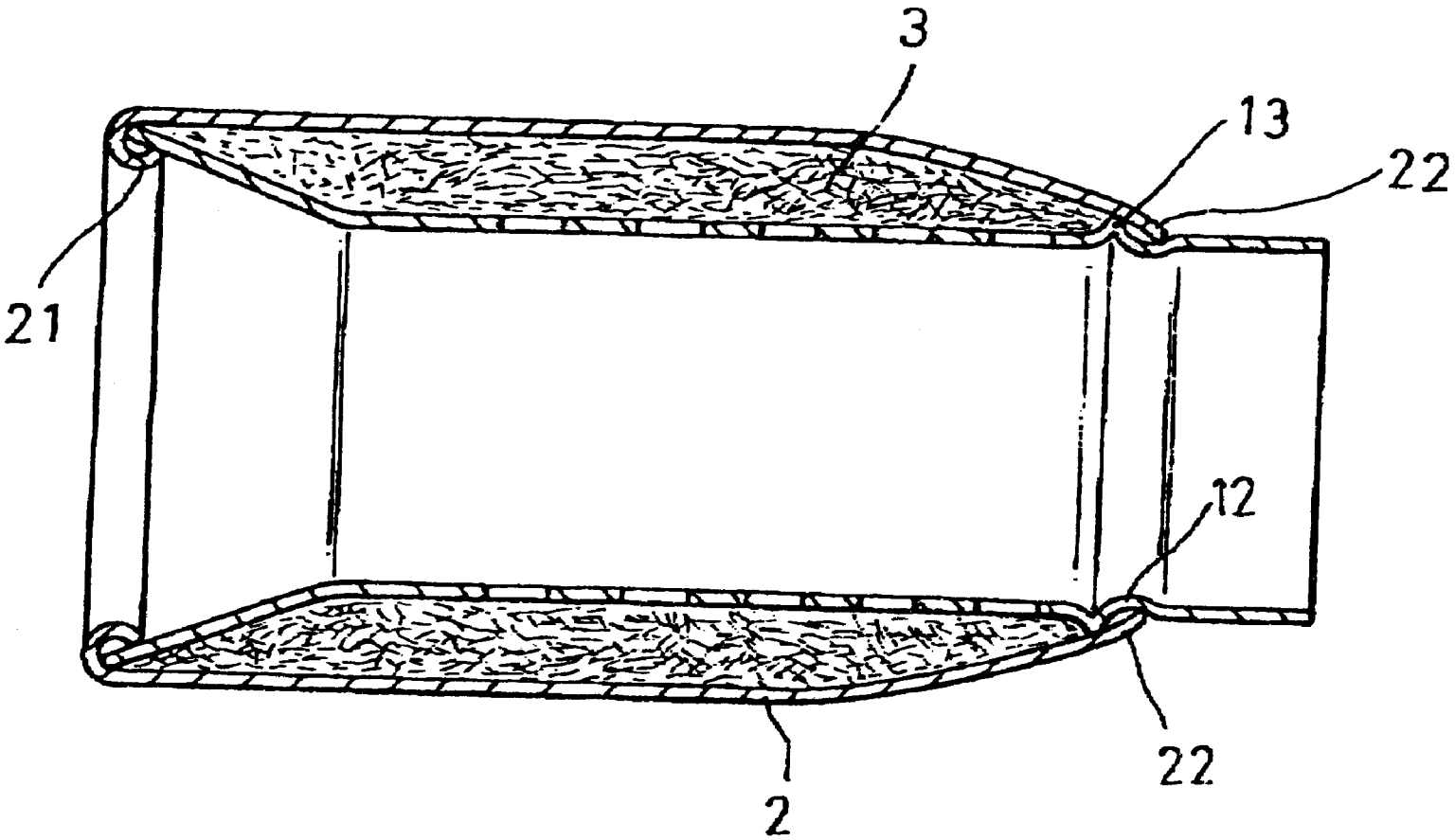
FIG. 4 shows a sectional schematic view of the preferred embodiment of the present invention in combination.

As shown in FIGS. 2–4, the muffler tube 1 is put into the outer tube 2 in which one end 21 of the outer tube 2 turns inwardly to receive the trumpet outlet 14 of the muffler tube. There is a space between the muffler tube 1 and the outer tube 2 for receiving the muffler cotton 3 into the space. In addition, the end edge 22 of the other end of outer tube 2 is retained at the concave annular trough 12 of the muffler tube 1, and the inner side of the outer tube 2 that adjacent the end edge 22 is engaged by the convex edge 13 of the muffler tube 1. Therefore, the connection between the muffler tube 1 and the outer tube 2 is very tight.

The muffler cotton 3 is filled into the space for improving noise elimination. The material of the muffler cotton 3 is cotton fiber or glass cotton which can withstand high temperatures.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exhaust tube comprising:

a muffler tube having a tubular shape with a plurality of holes formed in a central area thereof, said muffler tube having a concave annular trough formed in said tubular shape adjacent one end thereof, said muffler tube having a convex projection extending outwardly of said tubular shape adjacent said one end of said muffler tube, said annular trough positioned between said convex projection and said one end; and an outer tube extending over said muffler tube, said outer tube having an end edge received in said annular trough, said outer tube having an inner surface adjacent said end edge juxtaposed against said convex projection.

2. The exhaust tube of claim 1, said muffler tube having a trumpet-shaped outlet at an end opposite said annular trough, said outer tube having an inwardly turned portion gripping said trumpet-shaped outlet of said muffler tube.

3. The exhaust tube of claim 1, said muffler tube and said outer tube defining a space therebetween, the exhaust tube further comprising:

a muffler cotton filling said space, said muffler cotton selected from the group consisting of cotton fibers, glass fibers, and a mixture thereof.

* * * * *